US012751480B2

(12) United States Patent
Riddick et al.

(10) Patent No.: US 12,751,480 B2
(45) Date of Patent: Oct. 6, 2026

(54) SYSTEMS AND APPARATUS FOR REDUCING TOBACCO-SPECIFIC NITROSAMINES IN DARK-FIRE CURED TOBACCO THROUGH ELECTRONIC CONTROL OF CURING CONDITIONS

(71) Applicant: R. J. Reynolds Tobacco Company, Winston-Salem, NC (US)

(72) Inventors: Marvin Riddick, Winston-Salem, NC (US); Jerry Marshall, Winston-Salem, NC (US); Robert Parker, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1456 days.

(21) Appl. No.: 14/843,575

(22) Filed: Sep. 2, 2015

(65) Prior Publication Data

US 2017/0055565 A1 Mar. 2, 2017

(51) Int. Cl.
*A24B 1/02* (2006.01)
*A24B 15/18* (2006.01)

(52) U.S. Cl.
CPC ..... *A24B 1/02* (2013.01); *A24B 15/18* (2013.01)

(58) Field of Classification Search
CPC .... A24B 3/04; A24B 3/12; A24B 1/02; F26B 21/06; F26B 21/08; F26B 21/083; F26B 21/086; F26B 21/10; F26B 21/12
See application file for complete search history.

(56) References Cited

U.S. PATENT DOCUMENTS 646,218 A * 3/1900 Hollingsworth ..... A24B 3/04 131/302
2,134,843 A 11/1938 Rouse
(Continued)

FOREIGN PATENT DOCUMENTS

CN 1334048 2/2002
CN 201216165 4/2009
(Continued)

OTHER PUBLICATIONS

International Searching Authority—European Patent Office, Notification of Transmittal of the International Search Report and the Written Opinion of the International Searching Authority for PCT application PCT/US2016/049906; NL dated Jul. 25, 2017.
(Continued)

*Primary Examiner* — Philip Y Louie
*Assistant Examiner* — Yana B Krinker
(74) *Attorney, Agent, or Firm* — Womble Bond Dickinson (US) LLP

(57) ABSTRACT

The present invention relates to systems and apparatus for dark-fire curing of tobacco. Specially, the present invention provides a central control system for controlling and adjusting conditions within a structure utilized for curing dark-fired tobacco, for example by remotely turning the ventilation fan on or off. Additionally, the invention provides for an external smoking structure incorporated into the control system. This allows for simultaneous control of external smoking, that is smoking that is physically separated from curing, and the transportation of smoke into the into the dark-fire curing structure, in addition to the control of the curing structure itself.

23 Claims, 4 Drawing Sheets

(56) References Cited

U.S. PATENT DOCUMENTS

| | | | | |
|---|---|---|---|---|
| 2,752,144 | A | 6/1956 | Oldenkamp et al. | |
| 3,503,137 | A | 3/1970 | Wilson | |
| 3,664,034 | A | 5/1972 | Wilson | |
| 3,937,227 | A | 2/1976 | Azumano | |
| 3,999,303 | A * | 12/1976 | Martin | A24B 1/08 432/500 |
| 6,202,649 | B1 | 3/2001 | Williams | |
| 6,311,695 | B1 | 11/2001 | Williams | |
| 6,564,808 | B1 | 5/2003 | Hempfling et al. | |
| 6,846,177 | B1 | 1/2005 | Hutchens | |
| 7,404,406 | B2 | 7/2008 | Peele | |
| 7,624,740 | B2 | 12/2009 | Lipscomb et al. | |
| 7,650,891 | B1 | 1/2010 | Groves et al. | |
| 7,992,575 | B2 | 8/2011 | Cui et al. | |
| 8,151,804 | B2 | 4/2012 | Williams | |
| 2003/0145867 | A1 | 8/2003 | Bokelman et al. | |
| 2007/0003899 | A1 * | 1/2007 | Lipscomb | A24B 1/02 432/227 |
| 2012/0199145 | A1 | 8/2012 | Byrd et al. | |
| 2013/0306083 | A1 | 11/2013 | Riddick | |
| 2013/0319434 | A1 * | 12/2013 | Borschke | A24B 1/02 131/302 |
| 2014/0076339 | A1 | 3/2014 | Lusso et al. | |

FOREIGN PATENT DOCUMENTS

| | | |
|---|---|---|
| CN | 101807086 | 8/2010 |
| CN | 102178335 | 9/2011 |
| CN | 202184118 | 4/2012 |
| CN | 102987540 | 3/2013 |
| CN | 203072867 | 7/2013 |
| ES | 2187265 | 5/2003 |
| WO | 2005055746 | 6/2005 |

OTHER PUBLICATIONS

Patterson, Hannah; Future of Virginia Tobacco Burns Bright; United States of Agriculture—Virginia Mar. 11, 2015.

Ducan et al. Studies of Barn and Field Curing Environments on TSNA Formation in Burley Tobacco; UK University of Kentucky College of Agriculture; KY Oct. 31, 2001.

International Searching Authority—European Patent Office, Invitation to Pay Additional Fees and, where Applicable, Protest Fee for PCT application PCT/US2016/049906; NL dated Jun. 2, 2017.

* cited by examiner

SYSTEMS AND APPARATUS FOR REDUCING TOBACCO-SPECIFIC NITROSAMINES IN DARK-FIRE CURED TOBACCO THROUGH ELECTRONIC CONTROL OF CURING CONDITIONS

FIELD OF THE INVENTION

The present invention relates to systems and apparatus for dark-fire curing of tobacco. Specially, the present invention relates to a central control system for control of conditions within a structure utilized for curing dark-fired tobacco and for control of an external smoking structure for importing smoke into the curing structure.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco, and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999).

Through the years, various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. The sensory attributes of cigarette smoke can be enhanced by incorporating flavoring materials into various components of a cigarette. Exemplary flavoring additives include menthol and products of Maillard reactions, such as pyrazines, aminosugars, and Amadori compounds. See also, Leffingwell et al., Tobacco Flavoring for Smoking Products, R.J. Reynolds Tobacco Company (1972), which is incorporated herein by reference. In some cases, treatment processes involving the use of heat can impart to the processed tobacco a desired color or visual character, desired sensory properties, or a desired physical nature or texture. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 5,301,694 to Raymond et al.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; U.S. Pat. No. 6,591,841 to White et al.; and U.S. Pat. No. 6,695,924 to Dube et al.; and US Pat. Appl. Publication Nos. 2004/0173228 to Coleman, III; 2010/0037903 to Coleman, III et al.; and 2013/0014771 to Coleman, III et al., each of which is incorporated herein by reference. Additionally, examples of representative components that can be employed as so-called natural tar diluents in tobacco products are set in PCT WO 07/012980 to Lipowicz, which is incorporated herein by reference.

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; U.S. Pat. No. 5,387,416 to White et al.; and U.S. Pat. No. 8,336,557 to Kumar et al.; US Pat. Appl. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See, for example, the types of smokeless tobacco formulations, ingredients, and processing methodologies set forth in U.S. Pat. No. 6,953,040 to Atchley et al. and U.S. Pat. No. 7,032,601 to Atchley et al., each of which is incorporated herein by reference.

One type of smokeless tobacco product is referred to as "snuff." Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; Levi Garrett, Peachy, Taylor's Pride, Kodiak, Hawken Wintergreen, Grizzly, Dental, Kentucky King, and Mammoth Cave by Conwood Company, LLC; and Camel Orbs, Camel Sticks, and Camel Strips by R. J. Reynolds Tobacco Company.

The sensory attributes of smokeless tobacco can also be enhanced by incorporation of certain flavoring materials. See, for example, U.S. Pat. No. 6,668,839 to Williams; U.S. Pat. No. 6,834,654 to Williams; U.S. Pat. No. 7,032,601 to Atchley et al.; U.S. Pat. No. 7,694,686 to Atchley et al.; U.S. Pat. No. 7,861,728 to Holton, Jr. et al.; U.S. Pat. No. 7,819,124 to Strickland et al.; U.S. Pat. No. 7,810,507 to Dube et al.; and U.S. Pat. No. 8,168,855 to Nielsen et al; US Pat. Appl. Pub. Nos. 2004/0020503 to Williams, 2006/0191548 to Strickland et al.; 2007/0062549 to Holton, Jr. et al.; 2008/0029116 to Robinson et al.; 2008/0029117 to Mua et al.; and 2008/0173317 to Robinson et al., each of which is incorporated herein by reference.

Nitrosamines are known to be present in air, foods, beverages, cosmetics, and even pharmaceuticals. Preussman et al., Chemical Carcinogens, 2.sup.nd Ed., Vol. 2, Searle (Ed.) ACS Monograph 182, 829-868 (1984). Tobacco and tobacco smoke also are known to contain nitrosamines. Green et al., Rec. Adv. Tob. Sci., 22, 131 (1996). Tobacco is known to contain a class of nitrosamines known as tobacco specific nitrosamines (TSNA). Hecht, Chem. Res. Toxicol., 11(6), 559-603 (1998); Hecht, Mut. Res., 424(1,2), 127-142 (1999). TSNA have been reported to be present in smokeless tobacco, Brunnemann et al., Canc. Lett., 37, 7-16 (1987), Tricker, Canc. Lett., 42, 113-118 (1988), Andersen et al., Canc. Res., 49, 5895-5900 (1989); cigarette smoke, Spiegelhalder et al., Euro. J. Canc. Prev., 5(1), 33-38 (1996); Hoffman et al., J. Toxicol. Env. Hlth., 50, 307-364 (1997); Borgerding et al., Food Chem. Toxicol., 36, 169-182 (1997); nicotine-containing gum, Osterdahl, Food Chem. Toxic., 28(9), 619-622 (1990); and nicotine-containing transdermal patch, Adlkofer, In: Clarke et al. (Eds.), Effects of Nicotine on Biological Systems II, 17-25 (1995).

Green and freshly harvested tobaccos have been reported to be virtually free of TSNA. Parsons, Tob. Sci., 30, 81-82 (1986); Spiegelhalder et al., Euro. J. Canc. Prev., 5(1), 33-38 (1996); Brunnemann et al., J. Toxicol.-Clin. Toxicol., 19(6&7), 661-668 (1982-3); Andersen et al., J. Agric. Food Chem., 37(1), 44-50 (1989); Djordjevic et al., J. Agric. Food Chem., 37, 752-756 (1989). However, it has been observed that TSNA form during the post-harvest processing to which tobacco is subjected. Tricker, Canc. Lett., 42, 113-118 (1988); Chamberlain et al., J. Agric. Food Chem., 36, 48-50 (1988). TSNA are recognized as being formed when tobacco alkaloids, such as nicotine, are nitrosated. Hecht, Chem. Res. Toxicol., 11(6), 559-603 (1998). There has been considerable effort expended in reducing the formation of TSNA during the curing process.

Significant efforts have been expended towards studying the mechanism of TSNA formation during tobacco curing. As a result, it has been postulated that TSNA form during curing as a result of microbial mediated conversion of nitrate to nitrite, and the subsequent reaction of nitrate-derived chemical species with alkaloids present in the tobacco. Hamilton et al., Tob. Sci., 26, 133-137 (1982); Burton et al., J. Agric. Food Chem., 40, 1050-1055 (1992); Bush et al., Coresta Bulletin Information, Abstract 9814 (1995); Wiernik et al., Rec. Adv. Tob. Sci., 21, 39-80 (1995); Cui et al., TCRC (1996). Additionally, increased TSNA formation is correlated with increased temperature. Specifically, it has been shown that where the temperature in a curing barn rises above about 130° F. for an extended period of time the formation of TSNAs is markedly increased. Additionally, it has been shown that combustion bi-products in the exhaust of heat sources using direct fire burning may include oxides of nitrogen or $NO_x$ gas that may react with naturally occurring alkaloids in tobacco leaves also resulting in the formation of TSNAs.

Tobacco to be cured via dark-fire is ready for curing when the leaves are mature. Tobacco that is harvested too "green" will be more difficult to cure, while tobacco that is harvest overripe will be brittle and prone to leaf breakage. Generally, tobacco is allowed to wilt in the field prior to being housed in the barn or curing structure. When housing tobacco to be dark-fire cured the tobacco should not be packed or hung too tightly in the barn, as it removes the ability for ambient air to move throughout the barn.

Generally, the dark-fire curing process consists of four stages: yellowing; color setting; drying; and finishing. The yellowing stage occurs before fires are started when tobacco is housed in under natural or forced air ventilation, and continues until the yellowing of the tobacco leaf biomass is nearly complete. Additionally, it may be desired that a dark-fire curing barn be filled as quickly as possible in order to prevent various "stages" of yellowing. The color setting stage occurs following the yellowing and is characterized by temperature increases using fire as the heat source. During this stage the ventilators are usually closed and temperature is maintained between about 100° F. and 115° F. until the leaves are a solid brown color. During the drying stage the ventilators are opened and the temperature inside of the barn is heated by fire until the tobacco leaf midribs are completely darkened. This stage should not exceed 130° F. due to the increase of TSNAs formation above this temperature. After the stems, stalks, and leaves are darkened the temperatures is reduced and the volume of smoke within the barn is increased to "finish" the leaf surface.

Because tobacco has long been cultivated and tobacco products have accordingly long been made, yet with formation of nitrosamines in tobacco and tobacco products on many occasions and in many circumstances occurring, limiting the usefulness of such tobacco and tobacco products, there is a long-felt need for a process to minimize formation of TSNA, particularly at the curing stage. Further, because dark-fire curing utilizes smoking fire, and because an increase in temperature is correlated with an increase in TSNA formation there is a need to provide finer control of the dark-fire curing process, particularly as related to temperature.

SUMMARY OF THE INVENTION

A method and apparatus for real-time control and adjustment of conditions within a dark-fire curing structure is developed. The method and apparatus are realized by the use of a central control system (referred to herein simply as control system) which provides commands to control and adjust the conditions within the dark-fire curing structure and can optionally be incorporated into the simultaneous control of an external smoking structure and piping system for importing smoke into the dark-fire curing structure.

In some implementations, a method and apparatus are utilized to reduce the amount of tobacco-specific nitrosamines (TSNA) formed throughout the tobacco curing process when compared to an unassisted tobacco curing process.

In some implementations, a method and apparatus are utilized to retrofit the real-time control and adjustment of a curing structure into existing dark-fire curing structures or may be incorporated into the new construction of a dark-fire curing structure.

A method and apparatus are provided for real-time control and adjustment of a tobacco curing structure, with said curing structure having a plurality of both vertical and horizontal cross members for structural support. Additionally, the horizontal cross members provide support for hanging tobacco within the curing structure and support for a plurality of sensors distributed throughout the curing structure which may be, but are not limited to temperature (dry bulb and/or wet bulb) and relative humidity sensors. A control system is developed to receive and process said sensory data and in turn provides one of plurality of commands. The curing structure may include at least one ventilation fan coupled to the roof of the curing structure and at least one air intake vent or damper coupled to each side of the curing structure, wherein the air intake vent(s) or damper(s) are located on the lower quarter of the side of the curing structure. At least one heat/smoke source as means of generating smoke for the curing process may either be internal or external with respect to the curing structure and may utilize any smoking technique known in the art, such as burning sawdust, burning hardwood chips, burning hardwood slabs, and friction smoking. Utilizing a internal heat/smoke source for dark-fire curing of tobacco is well-known to a person of skill in the art, thus it does not warrant further discussion. Utilizing a external smoking structure as a heat/smoke source for dark-fire curing of tobacco will be disclosed further hereinafter.

Control systems for curing structures are commonplace in flue-curing of tobacco due to a ventilation fan(s) constantly running with variable speeds. See, for example, the Ventobacco VK981 (A) Curing Computer and the Cureco Inc. MA0526X-2 Auto Tobacco Barn Temperature and Damper Control. However, in dark-fire curing of tobacco, a ventilation fan(s) does not constantly run and is often physically manipulated by a user throughout various stages of the curing process. Thus, the need exists for a modification to one of these control systems or for an entirely new control system to be developed.

A control system minimally includes at least three components: a main memory where commands are stored prior to execution, a control unit or processor which utilizes inputs from the system to determine which command to execute, and a logic unit to execute the commands provided by the processor. In some implementations, a processor may be a microprocessor or other processor that is well-known in the art. At least one communication link (either wired or wireless) is utilized to facilitate communication between at least one apparatus of the curing structure and/or external smoking structure and the control system.

In some implementations, a method for control may be "set point" control, wherein a particular command occurs upon a set point being reached by a temperature and/or relative humidity sensor. A set point is a value in the control system, determined by a operator, that when reached, will cause the control system to provide the particular command. Actions that occur may be, but are not limited to turning on/off ventilation fan(s), adjusting the angle of air intake vent(s) or damper(s), and opening/closing of a outlet/inlet to control the flow of smoke. Set points and the corresponding actions or inactions can be readily changed by a user operated external device (either wired or wireless connection) during each stage of the curing process.

In some implementations, a method for control may be "repeat-read" control, wherein a temperature or relative humidity set point is reached, a ventilation fan(s) may turn on and/or a air intake vent(s) or damper(s) open for a predetermined amount of time (often less than a minute). Then, the ventilation fan(s) may turn off and/or the air intake vent(s) or damper(s) close so a new temperature and/or relative humidity sensor reading can be received by the control system. If the sensor reading is not below the temperature or relative humidity set point, the ventilation fan(s) may turn on and/or the air intake vent(s) or damper(s) open again. The control system may cause the curing structure to repeat this process until proper conditions within the structure are reached.

In some implementations, a external smoking structure and a piping system may be utilized rather than a internal heat/smoke source, wherein the piping system is interposed between the external smoking structure and the curing structure. The external smoking structure provides several advantages which include, but are not limited to: safety, due to the heat/smoke source location outside of the curing structure; cleaning of the smoke to reduce soot, ash, and charcoal from contacting the tobacco leaves, due to a filter the smoke passes through in the piping system; and simplicity in terms of controlling the smoke, due to outlet/inlet valves providing a plurality of actuatable and openable barriers to control the imported smoke from the external smoking structure to the curing structure. Piping smoke into a curing structure is commonplace in the food industry when smoking fish and meats, so it is a well-known technology that simply has not been applied to the tobacco curing industry. Additionally, a plurality of sensors are distributed throughout the external smoking structure, that may be, but are not limited to temperature and relative humidity sensors, to allow the control system to monitor the external heat/smoke source within said external smoking structure. This method provides control of a outlet from the external smoking structure into the piping system and a inlet from the piping system into the curing structure. The control of the outlet/inlet valves based on conditions in the external smoking structure and conditions within the curing structure.

In some implementations, a method to control and suppress smoke in a curing structure with a external smoking structure is utilized. The control system can alter the flow of smoke between the external structure and the curing structure by adjusting the angle of the outlet from the external smoking structure into the piping system or adjusting the angle of the inlet from the piping system into the curing structure. The ability to control the flow of smoke and remove its byproducts by filtration help prevent TSNA formation.

In some implementations, a method exists to access existing data and record new temperature profiles throughout the curing process. See, for example, Onset Computer Corporation's HOBO Data Loggers. This historical data and profiling allow a operator to track the curing data such as temperature and relative humidity for each curing process. Additionally, this allows the operator to make informed decisions when determining the amount of time to turn on/off ventilation fan(s) and open/close air intake vent(s) or damper(s) in repeat-read mode or when determining set points for each cure throughout the tobacco harvesting season. For example, if the operator has begun a curing process in April, then the air temperature outside of the curing structure will be cooler when compared to August, wherein the result of the cooler air temperature may result in the operator reducing time that the air intake vent(s) or damper(s) are open or change the angle at which they open. Having this historical data readily available for the operator should reduce the potential for human interference and error during the dark-fire curing process.

In some implementations, a control system can alert a operator when particular conditions occur by means of a connected user operated external device (either wired or wireless). Conditions that occur, wherein the operator is alerted may be, but are not limited to high/low relative humidity within a curing structure, and high/low temperature within a curing structure. From said external device, the operator may turn on/off a ventilation fan(s), open/close an air intake vent(s) or damper(s), etc.

Generally, a dark-fire curing process consists of four stages: yellowing; color setting; drying; and finishing. As discussed hereinbefore, each of said four curing stages call for a optimum conditions to reduce TSNA formation. A slight variation from these optimum conditions can markedly increase TSNA formation and render the tobacco harvest inadequate for sale and distribution. Thus, the need exists for real-time control and adjustment of a dark-fire tobacco curing structure to ensure a harvest is not wasted. The illustrated implementation allows for a operator to connect to a control system (either wired or wireless connection) to monitor each stage of the curing process. For example, during the drying stage, the operator may lower a temperature set point that triggers the ventilation fan(s) to turn on and the air intake vent(s) or damper(s) to open from 130° F. to 125° F.

In some implementations, a ventilation fan, or a plurality of ventilation fans depending on the size of the curing structure, allows for uniform distribution of ambient air throughout each stage of the curing process. In dark-fire curing, smoke is generated by a heat source and is drawn upwards by the ventilation fan(s) causing a condensate to form on each tobacco leaf. The ventilation fan(s) may operate at variable speeds to allow for different air-flow rates, wherein the air-flow rate is dependent on the size of the curing structure and the current stage of the curing process.

In some implementations, a air intake vent or damper, or a plurality of air intake vents or dampers depending on the size of the curing structure, in combination with the ventilation fan(s) allows for fresh air to enter the curing structure and flow uniformly throughout the curing structure. Generally, the air intake vent(s) or damper(s) are used to lower temperature and raise relative humidity levels, but may serve other purposes. Each air intake vent or damper has various degrees of openness to control the amount of fresh air entering the curing structure that an operator specifies.

It should be noted that although the disclosed method and apparatus discussed herein describe dark-fire curing of tobacco, it is not meant to be limiting and the invention has application in flue-curing of tobacco, air-curing of tobacco, etc.

Aspects of the present disclosure thus address the identified needs and provide other advantages detailed herein. Although the illustrated embodiments are depicted in specific ways, they are not meant to be limiting and one of ordinary skill in the art will recognize there is a multitude of viable implementations that achieve the same ends.

DETAILED DESCRIPTION OF DRAWINGS

Figure 1:
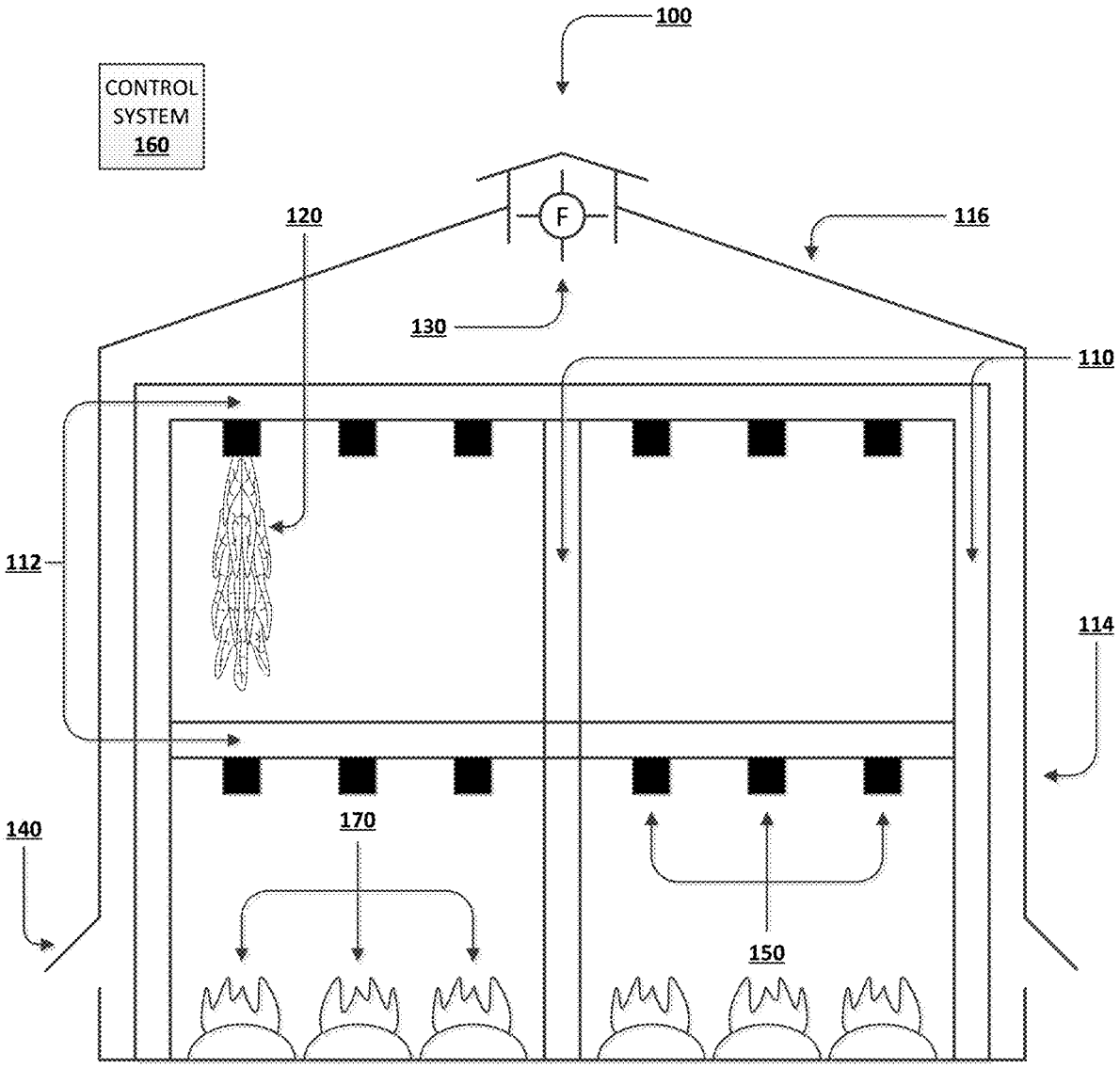
FIG. 1 is an elevational view of a dark-fire curing barn equipped with the central control system of the present invention.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

The selection of the plant from the *Nicotiana* species can vary; and in particular, the types of tobacco or tobaccos may vary. Descriptions of various types of tobaccos, growing practices and harvesting practices are set forth in *Tobacco Production, Chemistry and Technology*, Davis et al. (Eds.) (1999), which is incorporated herein by reference. Various representative types of plants from the *Nicotiana* species are set forth in Goodspeed, The Genus *Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N. x sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina*, and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis subsp. hersperis, N. pauciflora, N. petunioides, N. quadrivalvis, N. repanda, N. rotundifolia, N solanifolia* and *N. spegazzinii.*

*Nicotiana* species can be derived using genetic-modification or crossbreeding techniques (e.g., tobacco plants can be genetically engineered or crossbred to increase or decrease production of certain components or to otherwise change certain characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al.; and U.S. Pat. No. 7,230,160 to Benning et al.; US Patent Appl. Pub. No. 2006/0236434 to Conkling et al.; and PCT WO 2008/103935 to Nielsen et al.

For the preparation of smokeless and smokable tobacco products, it is typical for harvested plants of the *Nicotiana* species to be subjected to a curing process. Descriptions of various types of curing processes for various types of tobaccos are set forth in *Tobacco Production, Chemistry and Technology*, Davis et al. (Eds.) (1999).

The *Nicotiana* species can be selected for the type of biomass or anatomical part that it produces. For example, plants can be selected on the basis that those plants produce relatively abundant biomass or seed, produce biomass or seed that incorporate relatively high levels of specific desired components, and the like.

The *Nicotiana* species of plants can be grown under agronomic conditions so as to promote development of biomass or one or more anatomical parts. Tobacco plants can be grown in greenhouses, growth chambers, or outdoors in fields, or grown hydroponically.

The time of harvest during the life cycle of the plant can vary. For example, biomass or one or more anatomical parts can be harvested when immature. Alternatively, biomass or one or more anatomical parts can be harvested after the point that the plant has reached maturity. However, generally tobacco biomass to be cured via dark-fire curing is harvested when the leaves are mature.

Turning now to FIG. 1, which illustrates an embodiment of a typical dark-fire curing barn and the electronic control system of the present invention. The dark-fire curing barn 100 includes an internal skeletal framework, including a plurality of vertical support members 110 adjoined by a plurality of horizontal cross members 112, which may also serve as support for hanging tobacco 120. While only a portion of FIG. 1 is shown housing tobacco it is understood to those skilled in the art that a typical dark-fire barn in use may be completely full of tobacco hanging downward from the internal horizontal cross members 112. It may also be understood that it may be preferred for the barn to be completely full. The internal structural framework of the barn is covered by walls 114 and by a roof 116. As is typical of dark-fire curing barns, at least one ventilation fan 130 is present to provide air circulation and promote venting during the curing process. In some embodiments, particularly larger barns with multiple rooms, a plurality of fans may be preferred. Additionally, the barn has a plurality of fresh air intake vent or dampers 140 that may be operatively opened or closed in order to provide fresh air to the barn during the curing process (shown in the open position in FIG. 1).

The electronic control system of the present invention may be retrofitted into existing dark-fire curing barns, as depicted in FIG. 1, or may be incorporated into the new construction of a dark-fire curing structure. The electronic control system may have a plurality of temperature and relative humidity sensors 150 be distributed throughout the curing structure. These sensors measure the temperature and relative humidity of the air of their respective locations of the curing barn. The sensors are capable of measuring both the dry bulb and wet bulb temperatures. A dry bulb temperature, or ambient air temperature, is measured without regard to the moisture content of the air. A wet bulb temperature, in contrast, measures what the air temperature in a particular area would be if it were cooled to 100% relative humidity by the evaporation of water into it, or the lowest temperature that can be reached under the current environmental conditions by evaporation of water alone. These sensors are operatively connected to a central control system 160, which may be located within the curing structure or, as depicted in FIG. 1, outside of the curing structure. Sensors may be connected to the control system through a wired or wireless connection. The central control system 160 may also be operatively connected to other structures of the curing barn, including the ventilation fan(s) 130, fresh air intake vents or dampers 140, and/or the heat/smoke source for the barn (for example, an external smoking structure). The heat source in FIG. 1 is a smoking fire 170 at the base of the barn. These smoking fires in dark-fire curing structures may be controlled fires lit on a concrete base of the barn. Alternatively, the smoking fire may be lit within a pit dug in the earthen base of the barn. In another embodiment, that will be explained in greater detail later, the fire and smoke generation may be located externally, or physically separate from the curing structure.

Figure 2:
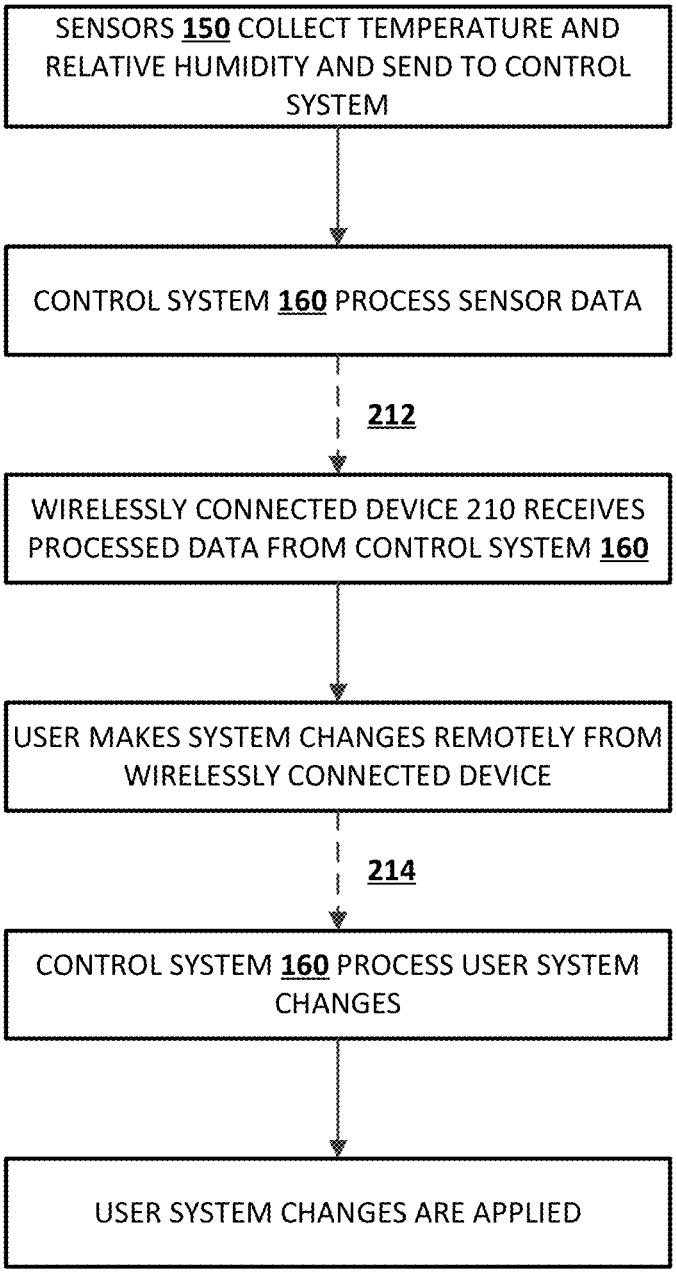
FIG. 2 is a flowchart illustrating an embodiment of the process of control utilizing the central control system of the present invention.

As shown in FIG. 2, the central control system 160 may communicate through sending a wireless signal 212 with a plurality of other wirelessly connected devices 210. Wirelessly connected devices may be, for example, from a group consisting of a smartphone, a smart watch, a tablet, or a computer. The wireless connectivity allows for the operator (often a farmer) to monitor temperature and humidity conditions inside the curing barn live from a remote location, such as their home, office, or in the field. After viewing a live reading, the operator may select, remotely through the control system, to turn a ventilation fan 130 on/off, temporarily open the air intake vents or dampers 140, or (where connected to the system) turn the heat/smoke source on/off by sending a wireless signal 214 to the control system 160. This allows for the operator to obtain finer, real-time, control of temperature and humidity conditions within the barn from a remote location.

Figure 3:
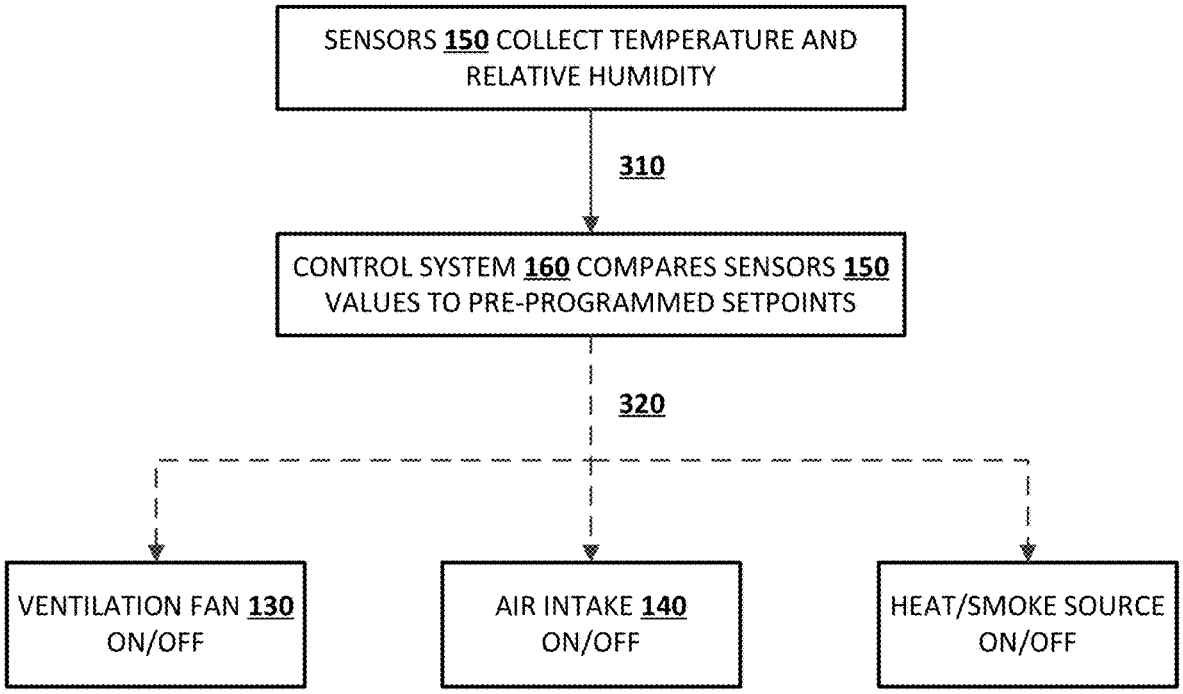
FIG. 3 is a flowchart illustrating an embodiment of the process of control utilizing the central control system of the present invention.

Additionally, or alternatively, the central control system 160 may be pre-programmed by the operator. Preprogramming may include programming the system to perform particular actions or inactions when particular conditions are met. For example, the system may be preprogrammed to push an alarm to the operator's electronic device if the temperature inside the curing structure reaches above a particular point. FIG. 3 use a flow chart to illustrate this process, where the sensors 150 take temperature and humidity measurements, which are electronically transmitted 310 to the central control system 160. The control system is operable to compare measured values to programmed threshold parameters which cause action or inaction. Where preprogrammed thresholds are met, a signal 320 is sent to the corresponding apparatus, for example to the ventilation fan 130 or to the air intake vent or damper 140. As an illustrative example, the control system may be preprogrammed that if the temperature sensors measure a dry bulb temperature of greater than 130° F. then the air intake vents or dampers should be opened for a set period of time, for example 15 seconds. Additionally, the central control system may be programmed to recheck sensor measurements a set period of time following an action generated by a preprogrammed threshold and repeat the action until the threshold parameter is no longer met. As an illustrative example, the control system may be programmed to recheck the sensors' temperature measurements 15 minutes following the opening of the air intake vents or dampers.

Alternatively, the control system may be preprogrammed to allow particular actions or inactions for a set time period, thus functioning similarly to a timer. It will be recognized by those of skill in the art that the central control system of the present invention may be preprogrammed any way such as to increase control, particularly over the parameters of temperature and humidity, of the curing process.

Figure 4:
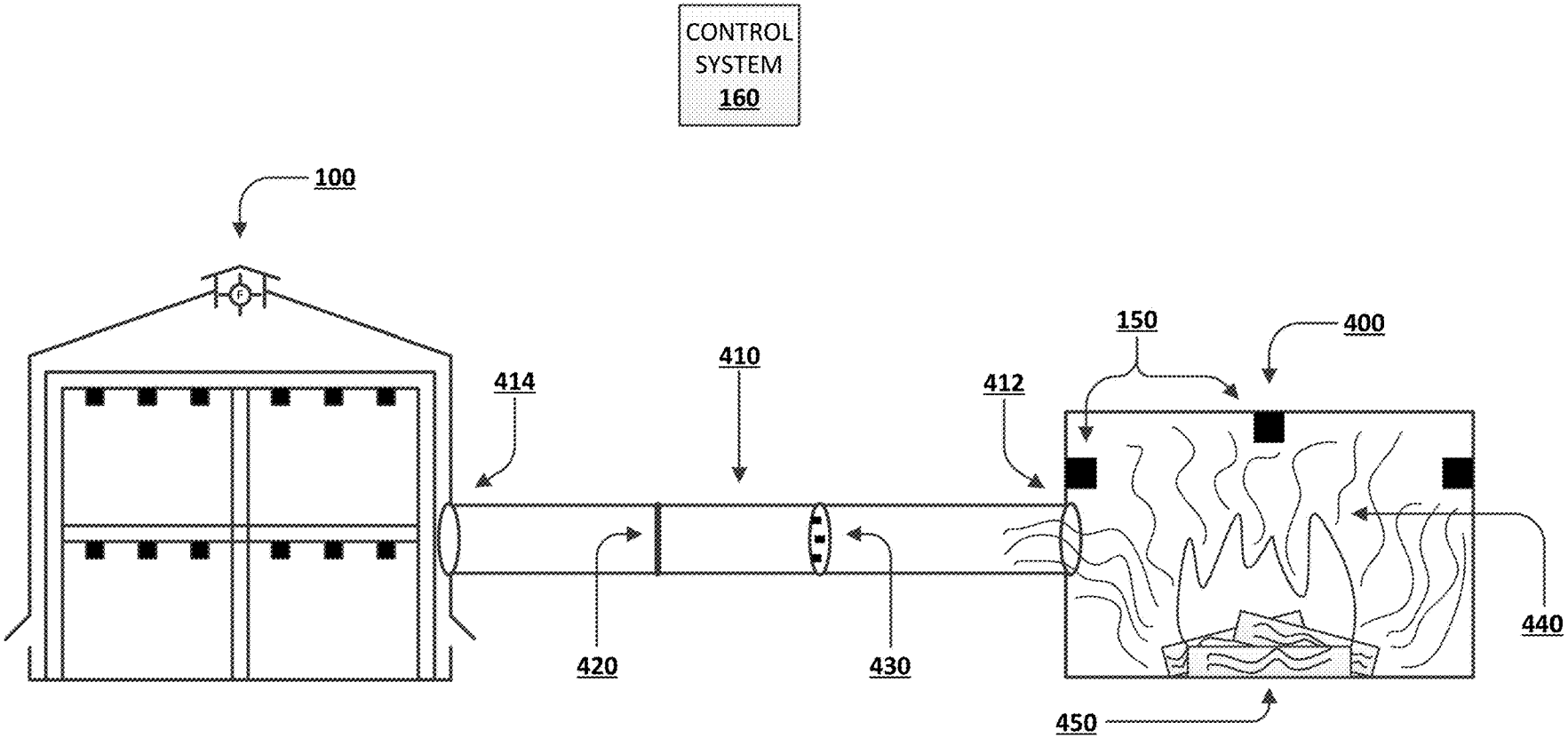
FIG. 4 is an elevational view of a dark-fire curing barn and external smoking structure equipped with the central control system of the present invention.

An alternative embodiment of the control system may incorporate external fire and smoke generation system, which is physically separate from the curing structure. The central control system may generally control the external smoke system itself, as well as the input from the external smoke system to the curing structure. As illustrated in FIG. 4, the external smoking structure 400 is physically separated from the curing structure 100. The physical distance between the barn and smoking structure is irrelevant, and may be long or may be short (as pictured). The two physically separated structures may be connected by a hollow enclosure 410 with two opposing open ends. The enclosure contains a first open end 412 that connects to the external smoking structure 400, and a second open end 414 that connects to the curing structure 100. Those of skill in the art will recognize that a plurality of hollow enclosures may be used to connect the external smoking structure to the curing structure, and may include, for example, piping or tubing.

Smoke may be generated inside of the external smoking structure by any means known in the art, including, for example, wood burning, friction smoking, or use of smoke condensate. Smoking 440 for dark-fire curing, as shown in FIG. 4 traditionally uses wood burning 450, which involves use of hardwood slabs or sawdust. Hardwoods are preferred for smoking, as they burn slower and more evenly than softer woods. Friction smoking involves a large wood block being pressed against a rotating metal wheel, which generates friction heat and causes the wood to slowly burn and mildly smoke. Smoke condensates are produced by smoldering wood shavings, condensing the resulting smoke in water, and cleaning the condensed smoke. The condensed smoke is regenerated for smoking and atomized in the smoking structure. Friction smoking and use of smoke condensate both contain lower levels of polycyclic aromatic hydrocarbons (PAHs) as compared to traditional smoking methods, and therefore may be preferable over traditional wood burning. Once generated by the method chosen, smoke may flow from the external smoking structure 400, through the hollow enclosure 410 to the curing structure 100.

Sensors 150, like those installed in the curing barn, are distributed throughout the external smoking structure. In addition to measuring temperature and humidity, the sensors inside of the smoking structure may also measure additional variables, such as the amount of smoke generated. Also like the sensors in the curing structure, these sensors are connected to the central control system 160. The control system may wirelessly communicate with the smoking structure and turn the heat/smoking element on/off depending on the conditions and needs of the curing barn. For example, if friction smoking is being utilized in the smoking structure the control system may send a signal to the metal wheel generating the friction to stop the spinning, and thus stop the generation of smoke. Utilizing a central control system and allowing communication with an external smoking structure allows for control of the amount of smoke generated.

Returning to FIG. 4, an actuatable and openable barrier 420 exists positioned between the curing structure 100 and the external smoking structure 400 (shown in the closed position). While shown in FIG. 4 as being placed within the hollow enclosure 410, those of skill in the art will recognize the actuatable and openable barrier may alternatively be placed at either end of the hallow enclosure. The actuatable and openable barrier 420 may be any type of solid barrier that prevent smoke from permeating through it, for example various metals. The central control system may control the opening and closing of the barrier through communications via wireless signals based on either preprogrammed parameters or operator command. Additionally, the barrier may be capable of opening and closing to varying degrees controlled by the central control system so that more or less smoke can be allowed into the curing structure depending on the how open or closed the barrier may be.

Since smoke generated by traditional wood burning may release nitrous oxide ($N_2O$) gases, which react with secondary alkaloids in tobacco to form tobacco specific nitrosamines, the use of alternative smoking methods, such as friction smoking or using smoke condensate, may aid in prevention of TSNAs formation. Additionally, physical separation of the smoking structure and the curing structure allows for the smoke to be "cleaned" prior to entering the curing structure where it may react with tobacco. As shown in FIG. 4, such "cleaning" may include the smoke passing through a filter 430 in order to filter out solid particles such as soot, ash, or charcoal. Other methods of "cleaning" smoke (not shown in FIG. 4) prior to it entering the curing chamber may include chemical treatment or washing of the smoke.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A central control system for use with dark-fire curing of tobacco comprising:

a plurality of sensors distributed throughout a dark-fire curing structure, wherein the dark-fire curing structure is connected to an external smoking structure by a hollow structure, wherein the external smoking structure has an outlet into the hollow structure and the hollow structure has an inlet into the dark fire-curing structure;

wherein an actuatable and openable barrier is positioned between the dark-fire curing structure and the external smoking structure and is configured to control an amount of smoke entering the dark-fire curing structure; and wherein a filter is positioned between the dark-fire curing structure and the external smoking structure and is configured to filter the smoke entering the dark-fire curing structure; and at least one communication link between the plurality of sensors and the central control system;

at least one communication link between the actuatable and openable barrier and the central control system;

the central control system operable to provide a command to a ventilation fan, an air intake vent, a heat/smoke source of the dark-fire curing structure, and the openable barrier by a communication link, and wherein the central control system is further operable to adjust an angle of the outlet from the external smoking structure into the hollow structure and/or an angle of the inlet from the hollow structure into the dark-fire curing structure.

2. The central control system of claim 1, wherein the plurality of sensors measure a dry bulb temperature, a wet bulb temperature, and/or relative humidity.

3. The central control system of claim 1, wherein the command is that the ventilation fan be set to one of turned on, turned off or a change of fan speed.

4. The central control system of claim 1, wherein the command between the central control system and the air intake vent is an open/close command.

5. The central control system of claim 1, wherein command provides that the heat/smoke source be turned one of on or off.

6. The central control system of claim 1, wherein the smoke is generated via wood burning within the external structure.

7. The central control system of claim 1, further comprising a means for cleaning the smoke prior to entering the dark fire-curing structure.

8. A central control system for use with dark-fire curing of tobacco comprising:

a plurality of sensors distributed throughout a dark-fire curing structure, wherein the dark-firing curing structure is connected to an external smoking structure by a hollow structure, wherein the external smoking structure has an outlet into the hollow structure and the hollow structure has an inlet into the dark fire-curing structure, wherein an actuatable and openable barrier is positioned between the dark-fire curing structure and the external smoking structure and is configured to control an amount of smoke entering the dark-fire curing structure; and wherein a filter is positioned between the dark-fire curing structure and the external smoking structure and is configured to filter the smoke entering the dark-fire curing structure;

wherein the plurality of sensors are in communication with the central control system;

a user operated external device in communication with the central control system and operable to transmit a user-initiated command to the central control system;

an apparatus of the dark-fire curing structure in communication with the central control system;

the apparatus of the dark-fire curing structure being an air intake vent and a ventilation fan;

wherein the central control system is operable, based upon the plurality of sensor data, to control the ventilation fan, the air intake vent and the actuatable and openable barrier between the dark-fire curing structure and an external smoking structure, and wherein the central control system is further operable to adjust an angle of the outlet from the external smoking structure into the hollow structure and/or an angle of the inlet from the hollow structure into the dark-fire curing structure.

9. The central control system of claim 8, wherein the plurality of sensors measure at least one of a dry bulb temperature, a wet bulb temperature and relative humidity.

10. The central control system of claim 8, wherein the user operated external device is selected from a group consisting of a smartphone, a smart watch, a tablet, or a computer.

11. The central control system of claim 8, wherein the user operated external device is operable to send a command to the central control system, the command indicating that the ventilation fan be turned on/off.

12. The central control system of claim 8, wherein the user operated external device is operable to send a command to the central control system, the command indicating that the air intake vent be opened/closed.

13. The central control system of claim 8, wherein the user operated external device is operable to send a command to the central control system, the command indicating that the actuatable and openable barrier be closed.

14. A central control system for use with dark-fire curing of tobacco comprising:

a plurality of sensors distributed in a dark-fire curing structure;

a plurality of sensors distributed in an external smoking structure;

a central control system;

wherein the plurality of sensors of the dark-fire curing structure are in communication with the central control system;

wherein the plurality of sensors of the external smoking structure are in communication with the central control system;

wherein the central control system is in communication with a ventilation fan, an air intake vent, and a heat/smoke source of the dark-fire curing structure, wherein the communication is based on the plurality of sensors distributed in a dark-fire curing structure and the plurality of sensors distributed in an external smoking structure, wherein the external smoking structure further comprises an outlet into a first open end of a hollow structure, the hollow structure further including a second open end connected to an inlet of a dark-fire curing structure, wherein a filter is positioned between the dark-fire curing structure and the external smoking structure and is configured to filter the smoke entering the dark-fire curing structure, and wherein the central control system is operable to adjust an angle of the outlet from the external smoking structure into the first open end of the hollow structure and/or an angle of the inlet from the hollow structure into the inlet of the dark-fire curing structure.

15. The central control system of claim 14, wherein the system further comprises:

a user operated external device in communication with the central control system and;

the user operated external device providing one of a plurality of commands to the central control system.

16. The central control system of claim 15, wherein the user operated external device is selected from a group consisting of a smartphone, a smart watch, a tablet, or a computer.

17. The central control system of claim 14, wherein the plurality of sensors measure a dry bulb temperature, a wet bulb temperature, and/or relative humidity.

18. The central control system of claim 14, wherein the communication between the central control system and the ventilation fan of the dark-fire curing structure includes a command representative of the ventilation fan be turned on/off.

19. The central control system of claim 14, wherein the communication between the central control system and the air intake vent of the dark-fire curing structure comprises a command that the air intake vent be opened/closed.

20. The central control system of claim 14, wherein the communication between the central control system and the heat/smoke source comprises a command that at least one heat/smoke source be turned on/off.

21. The central control system of claim 14, wherein the external smoking structure further includes:

an actuatable and openable barrier disposed between the hollow enclosure and the dark-fire curing structure, the central control system is operable to control the openable barrier.

22. An external smoking structure for use with dark-fire curing of tobacco comprising:

an external structure for smoking;

a smoke generator;

a plurality of sensors distributed throughout the external structure;

a hollow enclosure further including a first open end and a second open end;

wherein the first open end connects to the external structure for smoking and the second open end connects to a structure for dark-fire curing of tobacco;

an actuatable and openable barrier such that smoke generated by the external structure for smoking is imported from the external structure for smoking to the structure for dark-fire curing;

a filter disposed in the external structure or the hollow enclosure, wherein the filter results in a reduction of nitrous oxide in the smoke generated by the external structure imported to the structure for dark-fire curing;

wherein the structure for dark-fire curing includes an air intake vent and a ventilation fan; and a remote device in communication with the plurality of sensors and in controlling communication with at least one of the smoke generator, the air intake vent, the ventilation fan and the barrier in the hollow enclosure, and controlling communication to allow for adjusting the angle from the external structure to the first open end of the hollow enclosure and/or adjusting the angle from the second open end of the hollow enclosure to the structure for dark-fire curing;

wherein the smoke generator and actuable and openable barrier are controlled by the remote device based on a measurement from at least one of the plurality of sensors.

23. The external smoking structure of claim 22, wherein the hollow enclosure further comprises a plurality of actuatable and openable barriers to allow or prevent the smoke generated in the external structure to enter the hollow enclosure and/or curing structure.

* * * * *